US010275950B2

(12) United States Patent
Girard et al.

(10) Patent No.: US 10,275,950 B2
(45) Date of Patent: Apr. 30, 2019

(54) AVIONICS SYSTEM ADAPTED FOR EMPLOYING SMARTPHONE TO INPUT-OUTPUT FLIGHT DATA

(71) Applicant: BELL HELICOPTER TEXTRON INC., Fort Worth, TX (US)

(72) Inventors: William D. Girard, Euless, TX (US); Brian E. Tucker, Fort Worth, TX (US)

(73) Assignee: Bell Helicopter Textron Inc., Fort Worth, TX (US)

( * ) Notice: Subject to any disclaimer, the term of this patent is extended or adjusted under 35 U.S.C. 154(b) by 202 days.

(21) Appl. No.: 13/951,900

(22) Filed: Jul. 26, 2013

(65) Prior Publication Data

US 2015/0032296 A1 Jan. 29, 2015

(51) Int. Cl.
*G07C 5/00* (2006.01)

(52) U.S. Cl.
CPC ..... *G07C 5/008* (2013.01)

(58) Field of Classification Search
CPC ... H04L 67/12; H04L 67/06; H04L 29/08558; H04L 67/14; H04L 67/18; H04L 67/325
USPC ..... 701/3, 14, 120, 10, 100, 123, 2, 29.1
See application file for complete search history.

(56) References Cited

U.S. PATENT DOCUMENTS 6,148,179 A * 11/2000 Wright ..... G08G 5/0013 340/531
6,408,259 B1 * 6/2002 Goebel ..... B64D 43/00 701/100
7,755,890 B2 * 7/2010 Rui ..... B64D 43/00 348/837
7,769,501 B2 * 8/2010 Lusardi ..... G01C 23/00 340/945
8,280,741 B2 * 10/2012 Colin ..... G08G 5/0013 704/231
8,364,328 B2 1/2013 Hedrick
2002/0131730 A1 * 9/2002 Keeble ..... G02B 6/4201 385/92
2002/0140574 A1 * 10/2002 Starkey ..... B60C 23/0413 340/870.16
2004/0148088 A1 * 7/2004 Davis ..... G07C 5/008 701/123
2005/0026609 A1 * 2/2005 Brinkley ..... G06F 8/61 455/431
2007/0236366 A1 * 10/2007 Gur ..... G06K 9/00 340/945
2007/0264953 A1 * 11/2007 Srinivasan ..... H04L 67/06 455/186.1
2008/0228330 A1 * 9/2008 Srinivasan ..... G01C 23/00 701/3
2009/0220929 A1 * 9/2009 Daniel ..... G09B 9/00 434/362
(Continued)

*Primary Examiner* — Redhwan K Mawari
(74) *Attorney, Agent, or Firm* — James E. Walton

(57) ABSTRACT

A system and method configured to monitor aircraft flight performance data. The system includes a wireless transmitter in data communication with an avionics system of the aircraft, a portable wireless transceiver associated with the wireless transmitter, and a wireless database associated with the wireless transmitter. The method includes sensing flight performance data with the sensor, transmitting sensed flight performance data to the wireless transmitter, wirelessly transmitting the sensed flight performance data to the wireless database, and monitoring flight performance data with a display operably associated with the wireless database.

16 Claims, 2 Drawing Sheets

(56) References Cited

U.S. PATENT DOCUMENTS

| | | | | |
|---|---|---|---|---|
| 2010/0105329 | A1* | 4/2010 | Durand | G06F 1/1632 455/41.2 |
| 2011/0241902 | A1* | 10/2011 | Shavit | G08G 5/0026 340/978 |
| 2011/0313645 | A1* | 12/2011 | Shukla | G08G 5/065 701/120 |
| 2012/0053777 | A1* | 3/2012 | Meisels | G07C 5/006 701/29.1 |
| 2012/0265372 | A1* | 10/2012 | Hedrick | H04L 67/36 701/3 |
| 2013/0141572 | A1* | 6/2013 | Torres | H04N 7/185 348/143 |
| 2015/0032296 | A1* | 1/2015 | Girard | G07C 5/008 701/3 |

* cited by examiner

AVIONICS SYSTEM ADAPTED FOR EMPLOYING SMARTPHONE TO INPUT-OUTPUT FLIGHT DATA

BACKGROUND

1. Field of the Invention

The present application relates generally to aircraft avionics systems.

2. Description of Related Art

Aircraft avionics systems are well known in the art for control aircraft maneuverability. Prior to flight, the avionics systems are typically manually programmed with flight planning information. The manual process results in significant downtime, and in some scenarios, can result in mistakes due to incorrect input.

Conventional avionics systems can also be utilized to display and store flight performance information of the aircraft during flight. The information is useful for monitoring the aircraft performance, to assist with maintenance, and to provide feedback during pilot training.

Although the foregoing developments in the above-described system and method represent great strides, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
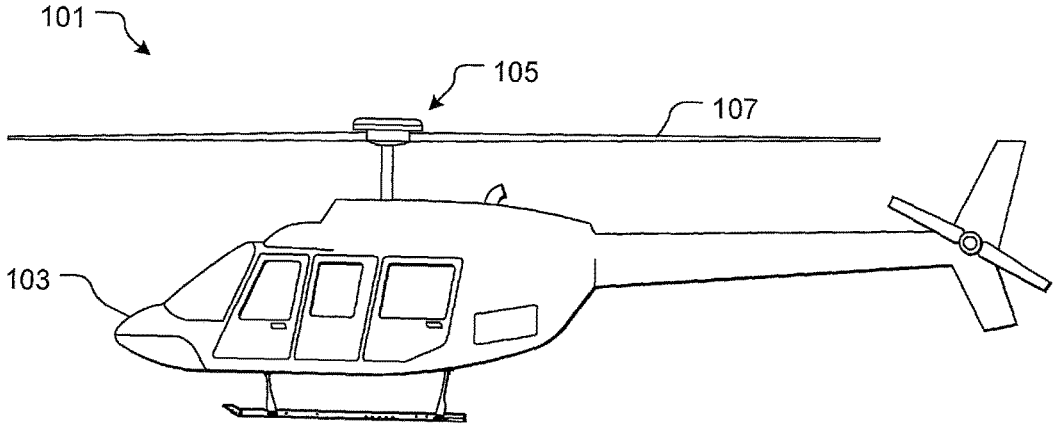
FIG. 1 is a side view of a helicopter according to a preferred embodiment of the present application.

While the system and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the apparatus and method are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system of the present application overcomes problems commonly associated with conventional avionic systems and methods. Specifically, the system includes a transmitter that wirelessly transmits flight performance data from the aircraft avionics system to a wireless database. Further, the system includes a portable wireless transceiver that receives and transmits flight performance data and/or pilot information associated with the flight performance data to the wireless database. The system provides rapid and effective means to monitor the flight performance of the aircraft, and to provide monitoring and training of the pilot. The system is also adapted to upload flight planning information to the avionics system of the aircraft. Further detailed description of these features are provided below and illustrated in the accompanying drawings.

The system and method of the present application will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Referring now to the drawings wherein like reference characters identify corresponding or similar elements throughout the several views, FIG. 1 depicts an aircraft 101 in accordance with a preferred embodiment of the present application. In the exemplary embodiment, aircraft 101 is a helicopter having a fuselage 103 and a rotor system 105 carried thereon. A plurality of rotor blades 107 is operably associated with rotor system 105 for creating flight.

Figure 2:
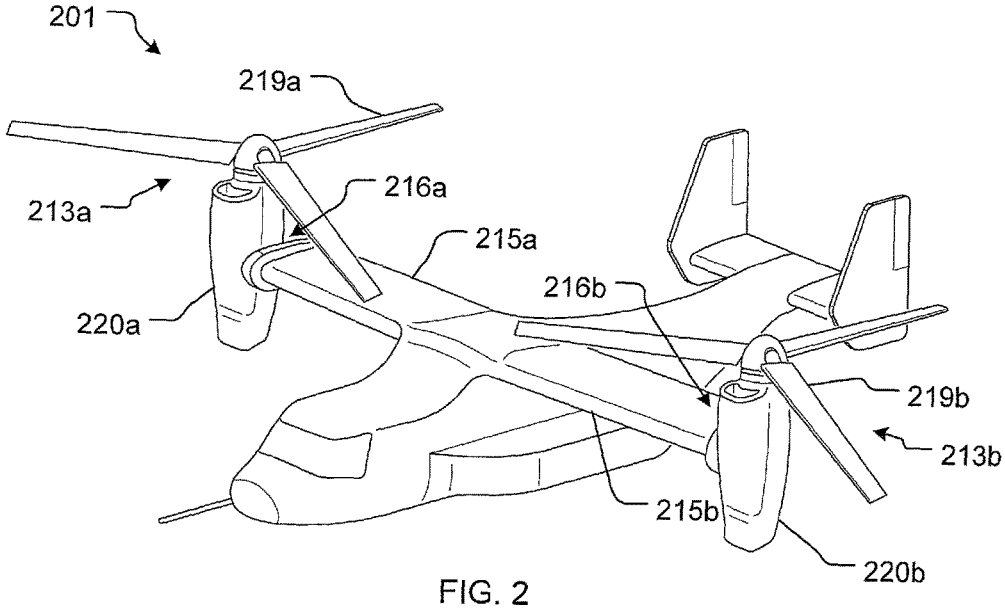
FIG. 2 is a perspective view of a tiltrotor aircraft according to an alternative embodiment of the present application.

Although shown associated with a helicopter, it will be appreciated that the system of the present application could also be utilized with different types of rotary aircraft and vehicles. For example, FIG. 2 illustrates a tiltrotor aircraft 201 that utilizes the damper system in accordance with the present application.

Tiltrotor aircraft 201 includes rotor assemblies 213*a* and 213*b* that are carried by wings 215*a* and 215*b*, and are disposed at end portions 216*a* and 216*b* of wings 215*a* and 215*b*, respectively. Tilt rotor assemblies 213*a* and 213*b* include nacelles 220*a* and 220*b*, which carry the engines and transmissions of tilt rotor aircraft 201, as well as, rotor proprotors 219*a* and 219*b* on forward ends 221*a* and 221*b* of tilt rotor assemblies 213*a* and 213*b*, respectively. Tilt rotor assemblies 213*a* and 213*b* move or rotate relative to wing members 215*a* and 215*b* between a helicopter mode in which tilt rotor assemblies 213*a* and 213*b* are tilted upward, such that tilt rotor aircraft 201 flies like a conventional helicopter; and an airplane mode in which tilt rotor assemblies 213*a* and 213*b* are tilted forward, such that tilt rotor aircraft 201 flies like a conventional propeller driven aircraft.

Figure 3:
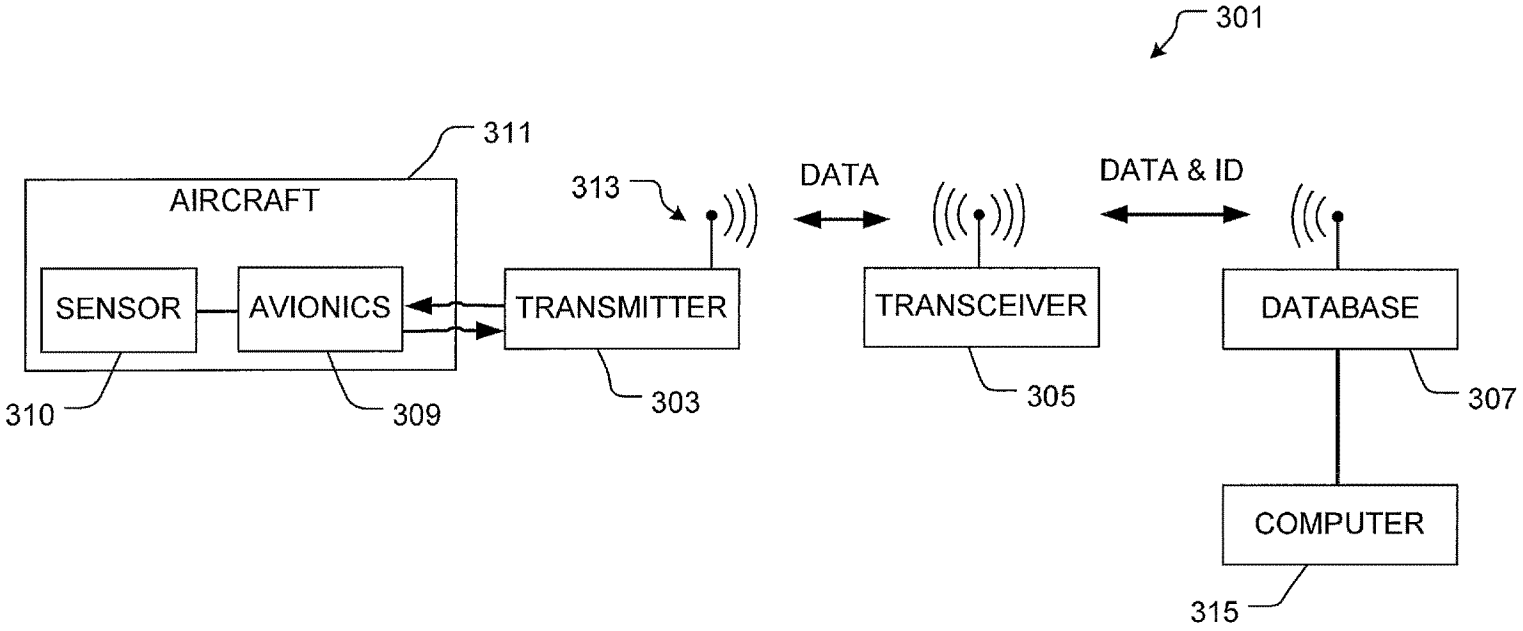
FIG. 3 is a simplified schematic of the fight performance monitoring, analysis, and feedback system in accordance with the preferred embodiment of the present application.

FIG. 3 shows a simplified schematic of system 301 according to the preferred embodiment of the present application. System 301 preferably includes one or more of a transmitter 303, a transceiver 305, and a database 307. It will be appreciated that the features of system 301 discussed herein are hereby incorporated in aircraft 101, 201, and other similarly suitable aircraft and/or vehicles.

Transmitter 303 is in data communication with an avionics system 309 associated with aircraft 311. During operation, a sensor 310 associated with avionics system 309 senses performance data of aircraft 311 during flight, which in turn is received, stored, and transmitted to transceiver 305.

In the preferred embodiment, transmitter 303 is a Secure Digital (SD) or a non-volatile memory card that is configured to receive, store, and/or transmit data to and from avionics system 309. To facilitate transmission, transmitter 303 includes a wireless device 313 configured to transmit data to and from transceiver 305. It will be appreciated that transmitter 303 could also be configured to fit within transceiver 305, e.g., a mini SD card fitted within a smartphone and/or portable tablet.

In the contemplated embodiment, transceiver 305 is a portable smartphone and/or tablet configured to receive data from transmitter 313 and relay the data to database 307. Transceiver 305 is also contemplated having a touch or voice key entry feature that enables a user to enter information to be relayed to avionics system 309 and/or database 307. For example, the pilot identification information associated with the flight performance data can be sent together to database 307.

Database 307 is configured to store data from transmitter 303 and can be operably associated with a computer 315 for viewing and analysis of the data via a computer display (not shown). In an alternative embodiment, database 307 could be adapted to send and receive data directly from transmitter 303, thereby eliminating the need for transceiver 305. It will be appreciated that database 307 could be configured to automatically populate aircraft and pilot logbooks with data received from the aircraft, e.g., flight hours, landings, and so forth. Conventional methods include the process of manually keeping the logbooks, and the above method would reduce the record-keeping burden and reduce the manual entry errors.

One feature believed unique to the present application is utilizing wireless means to transfer secured information from avionics system 309 to database 307. This process is achieved enables rapid and efficient means to convey data with little to no flight downtime. It should be understood that there are many different means of wireless communications that are contemplated, including, but not limited to, radio waves such as Bluetooth technology, cellular, Wi-Fi, Near Field Communication, and so forth. It is contemplated utilizing short-range wireless communication from transmitter 303 to transceiver 305 and utilizing long-range communication from transceiver 305 to database 307.

In one contemplated method of utilizing system 301, transmitter 303, with wireless communication capabilities, is inserted into the avionics system 309 prior to flight. Data, such as flight performance data, is written to transmitter 303 during flight, and once the flight is over, the user can then download the data directly to transceiver 305 or command the data to be sent directly to database 307, e.g, internet share or network. Once received by database 307, the user can analyze the data using third party software via computer 315.

In an alternative method, transmitter 303 could be configured to facilitate automatic download of flight performance data to either transceiver 305 and/or database 307 after flight.

It is also contemplated utilizing system 301 to upload flight planning data to avionics system 309. For example, a user can enter flight planning on transceiver 305 and/or other devices in communication with transmitter 303. The use can either wirelessly transmit the flight planning data to transmitter 303 or connect transmitter 303 directly to transceiver 305 and then thereafter connect transmitter 303 directly to avionics system 309. The user can then upload the flight planning information to avionics system 309. It will be appreciated that this process eliminates the need to manually enter flight planning information on avionics system 309, which commonly results in entry error.

It will be appreciated that system 301 provides the necessary link to facilitate the automatic download and/or upload of data to onboard avionics, without the need for specialized and dedicated onboard hardware. Also, the method of utilizing system 301 eliminates errors that can be caused by manual entry of flight planning information.

It will also be appreciated that the wireless connectivity discussed herein alleviates the need to remove/replace memory cards often, allows for easier integration with online/internet analysis solutions, improves user experience by integrating common devices into the solution. Another advantage of system 301 is that it uses non-aviation/off-board communication devices, e.g., transmitter 305 and computer 315, as the primary method, which allows for easier upgrades/improvements in hardware and software, as minimal qualification are required. Since the wireless communications is occurring through a standardized and controlled interface, e.g., writing data to transmitter 303, the onboard system is protected from malicious attacks to hardware through the wireless interface. The method also allows the data to be associated with the pilot/user via the transceiver 305 identity, removing the need for additional log-in and improve security with individual, unique pilot ID information.

In an alternative embodiment, it is contemplated utilizing a cable as means for data communication between transmitter 303 and avionics system 309. This embodiment could be utilized in aircraft that does not include ports for transmitter 303, e.g., a SD card port.

Utilizing system 301 as a training exercise is another contemplated method of use. For example, after flight, the flight performance information is sent to database 307 by one or more means discussed above, then thereafter reviewed by a flight instructor. Thereafter, the flight instructor can provide feedback based upon the flight performance data. It should be appreciated that one advantage of this method is to protect the privacy of the pilot's data so that only the instructor has access in lieu of multiple pilots having access. Confidentiality is often a requirement for many of the flight data monitoring programs normally imposed by pilot unions.

In one contemplated embodiment, computer 315 and transceiver 305 can be configured to communication directly with each other to provide feedback via automated rules. For example, computer 315 can process the data stored in database 307 and then transmit the analysis directly to the pilot on transceiver 305. This could take the form of individual events, e.g., "at 07:45, you conducted a banked turn of more than 30 degrees", and/or through use of a scoring system such as a safety score, e.g., "Your Safety Score for this flight was an A; no negative conditions were found."

It is apparent that a system and method with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An aircraft, comprising:

a sensor configured to sense flight performance of the aircraft during flight;

an avionics system associated with the sensor, the avionics system comprising:

a memory card interface;

a database in data communication with the sensor and the avionics system, the database being configured to store information relating to a pilot flying the aircraft during flight and the flight performance of the aircraft during flight;

a wireless transmitter having memory, the wireless transmitter in data communication with the avionics system and the database, the wireless transmitter comprising a non-volatile memory card coupled to the memory card interface of the avionics system; and a transceiver comprising an input device, the transceiver having a transceiver identity associated with pilot identification information, the transceiver being configured for receiving information relating to sensed flight performance from the wireless transmitter, for associating the thus received information with the pilot identification information associated with the transceiver identity, and for transmitting the received information with the thus associated pilot identification information to the database;

wherein the transceiver is a wireless transceiver in data communication with the wireless transmitter;

wherein the wireless transceiver is configured to wirelessly receive and transmit aircraft flight performance data to the database;

wherein the stored sensed flight performance is only accessible with the associated pilot identification information;

wherein the avionics system is configured to monitor aircraft flight performance data from the sensor; and wherein the pilot identification information is entered directly into the input device of the transceiver.

2. The aircraft of claim 1, wherein the transceiver is portable.

3. The aircraft of claim 2, wherein the transceiver is a smartphone.

4. The aircraft of claim 1, wherein the transceiver is configured to upload data to the avionics system via the wireless transmitter.

5. The aircraft of claim 4, wherein the uploaded data is a flight planning data.

6. The aircraft of claim 1, wherein the wireless transmitter removably attaches to the wireless transceiver.

7. The aircraft of claim 1, wherein the wireless transmitter removably attaches to the avionics system, the non-volatile memory card being an SD card.

8. The aircraft of claim 1, wherein the transceiver is configured to receive and store aircraft flight performance data.

9. An aircraft flight performance monitoring system, comprising:

a wireless transmitter having memory, the wireless transmitter in data communication with an avionics system of an aircraft, the avionics system comprising a memory card interface and the wireless transmitter comprising a non-volatile memory card coupled to the memory card interface of the avionics system;

a database in data communication with the avionics system, the database being configured to store information relating to a pilot flying the aircraft during flight and flight performance of the aircraft during flight;

a transceiver comprising an input device; the transceiver having a transceiver identity associated with pilot identification information, the transceiver being configured for receiving information relating to sensed flight performance from the wireless transmitter, for associating the thus received information with the pilot identification information associated with the transceiver identity, and for transmitting the received information with the thus associated pilot identification information to the database;

wherein the stored sensed flight performance is only accessible with the associated pilot identification information;

wherein the wireless transmitter is configured to receive and transmit flight performance data from the avionics system to the transceiver, which in turn is transmitted to the database; and wherein the pilot identification information is entered directly into the input device of the transceiver.

10. The system of claim 9, wherein the wireless transmitter removably attaches to the avionics system.

11. The system of claim 10, wherein the transceiver is configured to wirelessly receive information from the wireless transmitter.

12. The system of claim 9, wherein the transceiver is a smartphone.

13. A method to monitor aircraft flight performance data, comprising:

providing an avionics system comprising:

a sensor for sensing flight performance data; and a memory card interface;

sensing flight performance data with the sensor;

providing a wireless transmitter comprising:

memory; and a non-volatile memory card configured for coupling to the memory card interface of the avionics system;

transmitting the sensed flight performance data to a transceiver having a transceiver identity associated with pilot identification information;

entering the pilot identification information directly on the transceiver;

associating, by the transceiver, the sensed flight performance data received from the wireless transmitter with the pilot identification information associated with the transceiver identity;

transmitting, by the transceiver, the received sensed flight performance data with the associated pilot identification information to a database; and allowing access to the received sensed flight performance data only with the associated pilot identification information.

14. The method of claim 13, wherein the transmitting by the transceiver of the associated sensed flight performance data and pilot identification information includes wirelessly transmitting the associated sensed flight performance data and pilot identification information to the database.

15. The method of claim 14, further comprising:

removably attaching the wireless transmitter to the transceiver.

16. The method of claim 13, wherein the non-volatile memory card is an SD card.

* * * * *